114-253 SR
11/10/81 OR 4,299,184

United States Patent [19]
Mougin

[11] 4,299,184
[45] Nov. 10, 1981

[54] METHOD OF TOWING LARGE MASSES AT SEA

[75] Inventor: Georges L. Mougin, Paris, France

[73] Assignee: ITI, Limited, Paris, France

[21] Appl. No.: 96,036

[22] Filed: Nov. 20, 1979

[30] Foreign Application Priority Data

Feb. 26, 1979 [GB] United Kingdom ..... 06661/79

[51] Int. Cl.[3] ..... B63B 21/56
[52] U.S. Cl. ..... 114/253; 114/311; 440/34
[58] Field of Search ..... 114/242, 311, 253; 440/13, 17, 19, 33, 34, 98, 113

[56] References Cited

U.S. PATENT DOCUMENTS

| | | | |
|---|---|---|---|
| 14,973 | 5/1856 | Ross | 440/17 X |
| 1,206,247 | 11/1916 | Ream | 440/36 |
| 2,536,682 | 1/1951 | Frieder et al. | 114/311 |
| 3,472,195 | 10/1969 | Chiba | 114/311 |

FOREIGN PATENT DOCUMENTS

| | | | |
|---|---|---|---|
| 2753046 | 3/1979 | Fed. Rep. of Germany | 114/311 |

*Primary Examiner*—Robert B. Reeves
*Assistant Examiner*—Douglas D. Watts
*Attorney, Agent, or Firm*—George E. Kersey

[57] ABSTRACT

A large floating mass (10) such as an off-shore structure or an iceberg is towed using two sea anchors (20 & 30) alternately. The motive power for towing is derived from winch means (15 & 16) on the large floating mass or on a barge immediately in front of it. The cable by which the towing force is transmitted runs from one of the sea anchors to the other so that it is payed out to one while the other is being winched towards the mass. The sea anchors are arranged to offer little resistance to forward movement through the water, but to offer a large resistance to backward movement, thereby offering a purchase from which towing is effected. The advantage of using two sea anchors is that with an alternating succession of towing operations it is possible to keep a substantially continuous tractive effort acting on the mass.

5 Claims, 4 Drawing Figures

METHOD OF TOWING LARGE MASSES AT SEA

The present invention relates to a method of towing large floating masses at sea, for example off-shore structures or icebergs. There have been various proposals for towing such masses using a large sea anchor and traction winches (eg our U.K. patent application No. 53816/77). The idea is to deploy the large sea anchor ahead of the mass and then to pull the mass and the anchor towards each other by winching. After an initial traction session, it is necessary to move the anchor forwards, away from the mass before starting a second traction session. Even with arrangements using sea anchors which present relatively little resistance to movement through water in the forward direction, there is a considerable pause between two traction sessions, during which the mass under tow will loose way.

The aim of the present invention is to provide a method of towing a large mass at sea, by means of a sea anchor, but with the pauses between successive traction sessions being greatly reduced. In preferred applications these pauses may even be substantially eliminated.

The present invention provides a method of towing a large mass at sea, the method comprising the steps of providing the large mass with traction winch means, deploying two sea anchors ahead of the mass in the desired towing direction, providing cable means connecting each of the sea anchors to the traction winch means, and towing the mass in an alternating sequence of traction sessions during each of which one of the sea anchors is winched towards the mass by the winch means winching in the cable means attached thereto and paying out the cable means attached to the other sea anchor, and the other sea anchor being moved forwards as its cable means is payed out to prepare it for the following traction session in which the roles of the sea anchors are interchanged, whereby the pause between successive traction sessions can be limited to the time necessary for reversing the direction of operation of the winch means.

Preferably the cable means runs from one of the sea anchors to the other sea anchor via the winch means whereby the sum of the distances of the sea anchors ahead of the mass remains substantially constant.

The sea anchors may be deployed one behind the other such that they tend to move towards each other during one alternation of the sequence and to move apart during the next alternation and so on.

Whatever their deployment, the sea anchors may be provided with spreader motors which serve to keep the sea anchor spread out during the traction sessions in which the sea anchor is being winched towards the large mass, and which serve to move the sea anchor forwards during the alternate traction sessions.

One mode of performing the invention is described in greater detail by way of example and with reference to the accompanying drawings in which.

Figure 1:
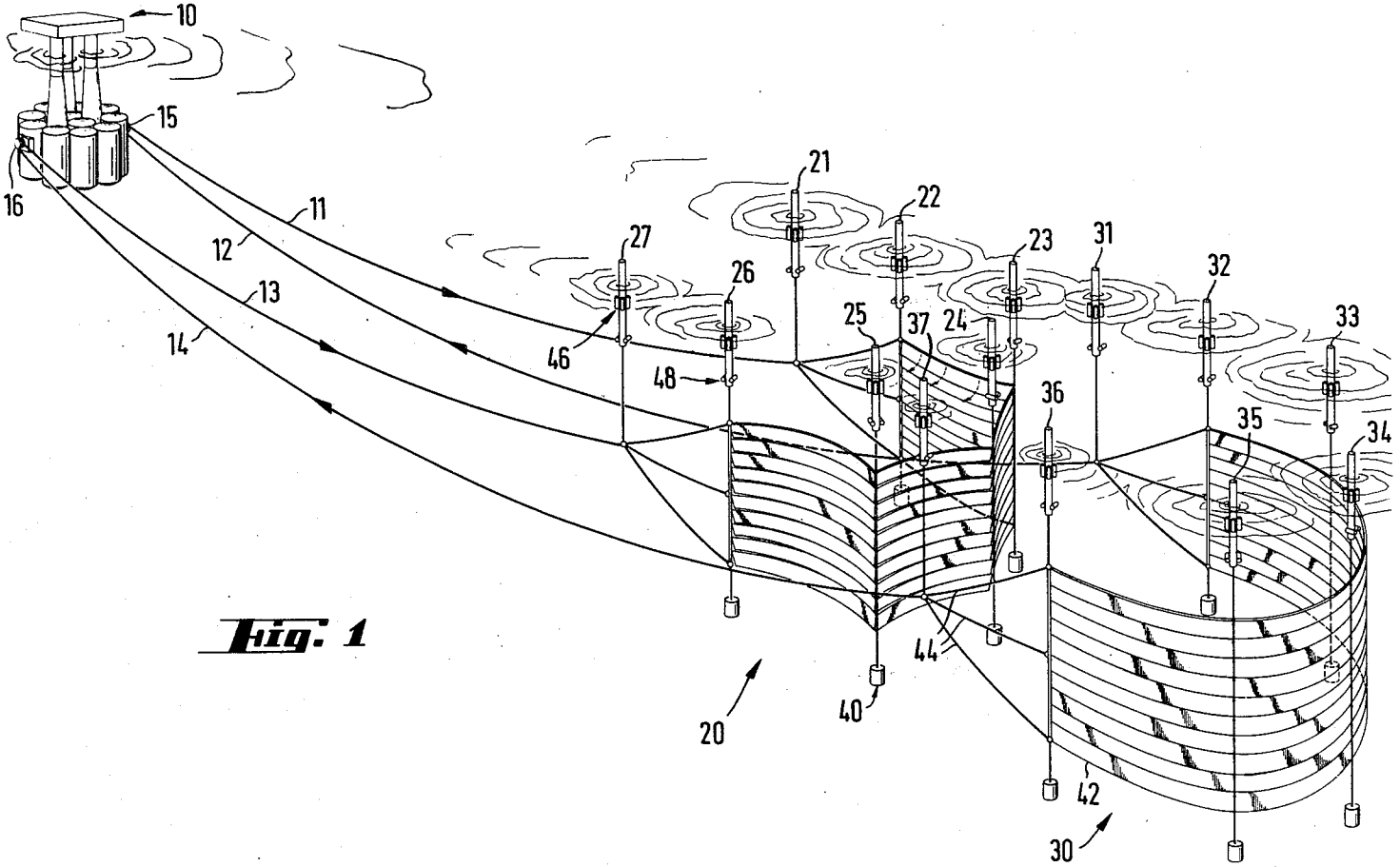
FIG. 1 is a perspective view of a large floating mass being towed from a front sea anchor while a rear sea anchor is moving forwards.

With reference to FIG. 1, it can be seen that a large floating mass (10), in this case an off-shore weight structure for an oil field, has four lengths of cable connecting it to two sea anchors (20 and 30). In fact, the port lengths 11 and 12 and the starboard lengths (13 and 14) are formed by respective single port and starboard cables which pass from one of the sea anchors around respective port and starboard traction winches (15 and 16) and continue to the other sea anchor. The traction winches (15 and 16) are submerged and have a common horizontal axis of rotation which is perpendicular to the desired line of travel.

The forward sea anchor (30) is being winched towards the floating mass (10) by means of the cable lengths (12 and 14). After a few turns round the respective winches (15 and 16) the cable is payed out along lengths (11 and 13) to the rear sea anchor (20). One advantage of this "in and out" arrangement is that there is no need for extensive storage for the cables on or near the winches (15 and 16). This becomes appreciable in the case shown where the total length of each cable from one of the sea anchors, round its winch and back to the other sea anchor is in the order of 7 km.

Each sea anchor, (20, 30) comprises seven floats (21 to 27) or (31 to 37) of a form suitable for remaining substantially stable vertically in a swell. From each of the floats (22 to 26 and 33 to 36) there is a vertical cable extending downwards under the effect of sinker (40) and there is an array of horizontal cables suspended between the vertical cables and supporting horizontal strips (eg 42) of flexible material. These strips (42) overlap in the manner of tiles on a roof so that the sea anchors offer much greater resistance to movement in one direction (eg the sea anchor 30) than to movement in the other direction when the strips (42) separate to let water through in between each other. This is described in greater detail below with reference to FIGS. 3 and 4.

Each of the lengths of cable (11 to 14) is terminated at the anchor end at the bottom of a cable suspended below the end floats (21 and 27) and (31 and 37). From the point of termination there is a bridle of traces (44) connecting to various points along the height of the cables supporting the ends of the strips (42). For simplicity in the figure only three traces (44) are shown which would be workable if the end vertical cables suspended from the floats (22, 26, 32, and 36) are stiff beam-like structures, but the preferred arrangement is to have one trace (44) for each strip (42).

Each float comprises a vertical pole of relatively small diameter such that movement of the water-line up and down the pole with passing waves causes a small net change in its buoyancy thrust. The main part of the floats' buoyancy comes from a set of buoyancy chambers (46) located below the depth of the deepest expected wave troughs. Even deeper below the water-line each float includes a pair of horizontally directed thrusters (48). These thrusters serve two purposes; when the sea anchor is being used as a sea anchor they keep its mouth open by thrusting the end poles outwards; while when the sea anchor is moving forwards the thrusters (48) provide the required motive power.

Figure 2:
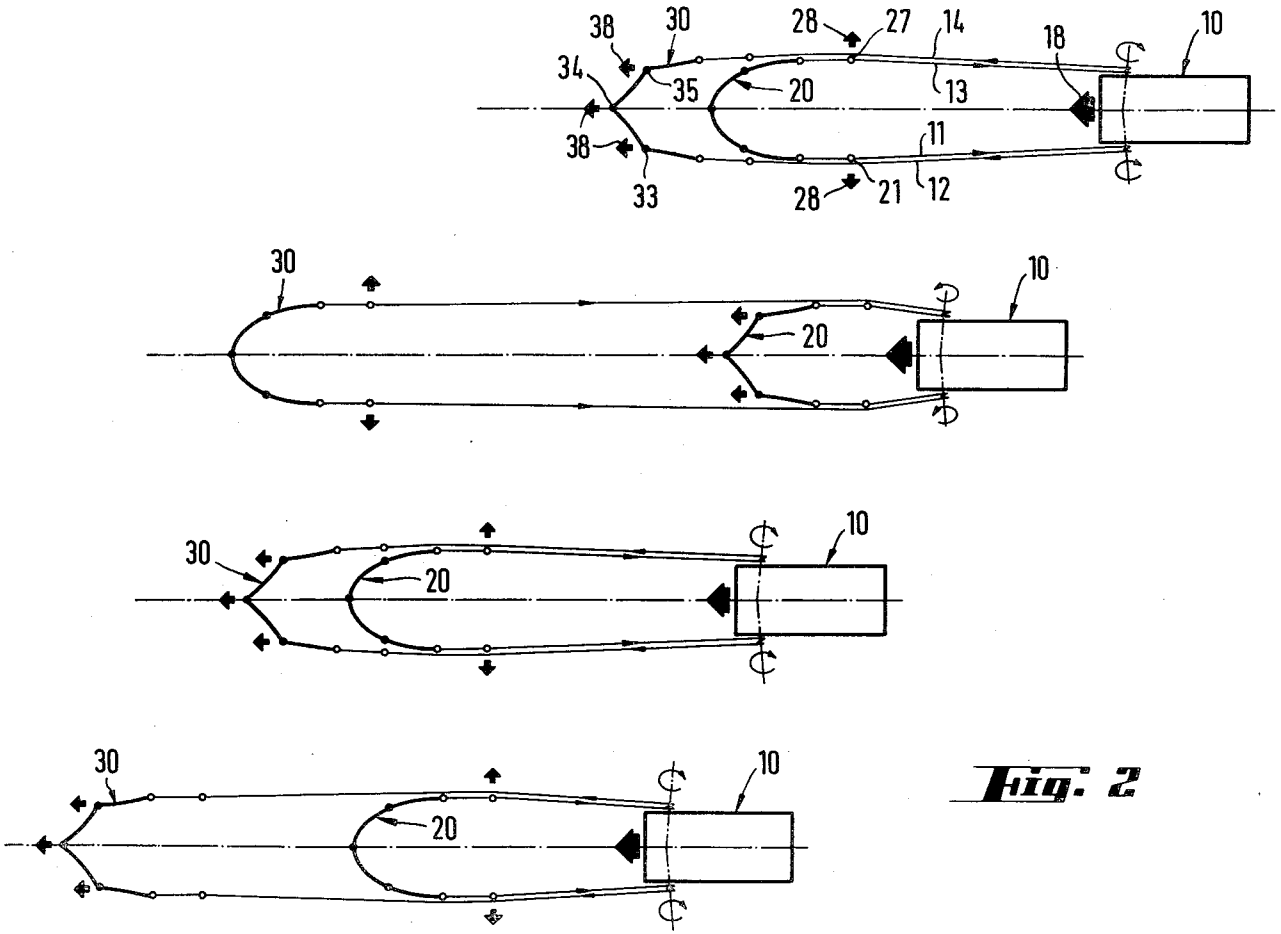
FIG. 2 is a plan view of four stages of a towing operation.

The operation of the equipment shown in FIG. 1 will be better understood from FIG. 2 whose first line shows the situation shortly after the position shown in FIG. 1. In FIG. 2 the floating mass (10) is shown schematically as a rectangle, and its movement is shown by a broad arrow (18). Taking the sequence of events from FIG. 1, it is clear that winching in of the forward sea anchor (30) must shortly cease since it is about to collide with the forwardly moving rear sea anchor (20). Thus the winches (15 and 16) are reversed and the position shown in the first line of FIG. 2 is obtained. Cable lengths (11 and 13) are being winched in while corresponding lengths (12 and 14) are being paid out. The sea anchor (20) is stretched taut and its mouth is kept open by the thrusters on its end floats (21 and 27) acting outwardly in the directions shown by small arrows (28). Meanwhile the forward sea anchor (30) is being moved forwards by the thrusters of its middle floats (33, 34, and 35) acting in the direction of small arrows (38).

Under typical operating conditions, each alternation of the towing cycle (one towing session) will last for about one hour during which time the mass (10) will move about one nautical mile while the sea anchor from which it is being towed will move back about one tenth of that distance. The forwardly moving sea anchor covers two sea miles forwards during the same period.

The end of the towing session begun in the first line of FIG. 2 is shown in the second line, and likewise the end of the next towing session is shown in the third line. The fourth line shows an intermediate position during the following towing session.

Figure 3:
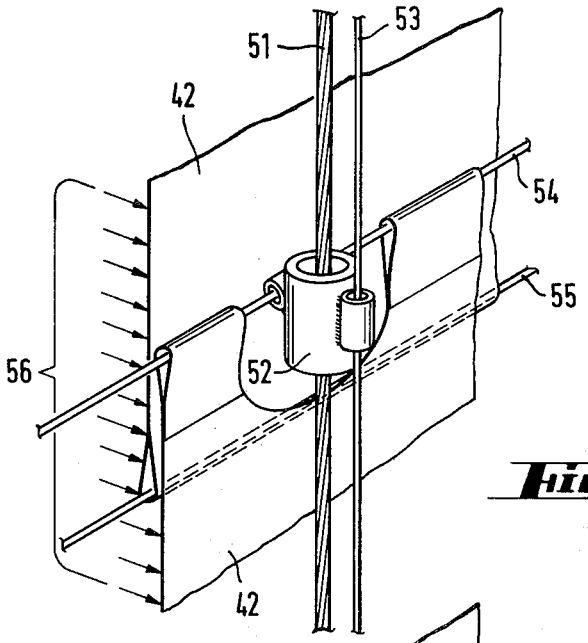
FIGS. 3 and 4 are perspective views showing a detail of a sea anchor when acting as an anchor (FIG. 3) and when moving forward (FIG. 4).
Figure 4:
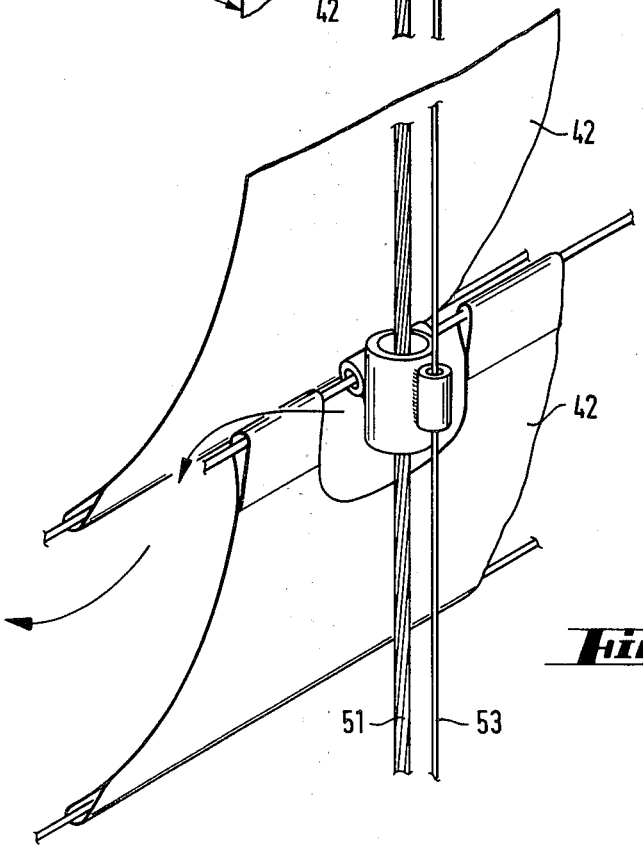

FIGS. 3 and 4 show a detail of the sea anchors. A large vertical cable (51) extends between a float and a sinker (not shown in these figures). A fitting (52) is loosely mounted around the large vertical cable (51) and fast to a smaller vertical cable (53). The fitting supports a horizontal cable (54) which is lodged in the upper hem of one of the strips (42) and thereby supports it. The lower hem of the strip (42) is ballasted with a free cable (55). In FIG. 3 two strips (42) overlap and present a large resistance to pressure applied in the direction of arrows (56). Conversely in FIG. 4 pressure applied in the opposite direction merely separates the strips (42) and allows water to pass freely through the sea-anchor.

The sliding fitting arrangement is to facilitate raising and lowering of the sea anchor and is described elsewhere (eg our above-referenced patent application).

The method of the invention is capable of several modifications, in particular the winches need not be mounted on the large floating mass itself, but on an intermediate vessel which is connected to the said large mass by further cables.

| LIST OF REFERENCE NUMERALS | |
|---|---|
| 10 | large mass |
| 11,12 | port lengths of cable |
| 13,14 | starboard lengths of cable |
| 15,16 | port and starboard traction winches |
| 18 | movement of mass 10 |
| 20 | rear sea anchor |
| 21 } 27 | floats |

-continued

| LIST OF REFERENCE NUMERALS | |
|---|---|
| 28 | small arrows |
| 30 | forward sea anchor |
| 31 } 37 | floats |
| 38 | small arrows |
| 40 | sinker |
| 42 | strip |
| 44 | traces |
| 46 | buoyancy chambers |
| 48 | pair of thrusters |
| 51 | large vertical cable |
| 52 | fitting |
| 53 | small vertical cable |
| 54 | horizontal cable |
| 55 | free cable |
| 56 | pressure indicated by arrows |

I claim:

1. A method of towing a large mass at sea, the method comprising the steps of providing the large mass with traction winch means, deploying two sea anchors ahead of the mass in the desired towing direction, providing cable means connecting each of the sea anchors to the traction winch means, and towing the mass in an alternating sequence of traction sessions during each of which one of the sea anchors is winched towards the mass by the winch means winching in the cable means attached thereto and paying out the cable means attached to the other sea anchor, and the other sea anchor being moved forwards as its cable means is payed out to prepare it for the following traction session in which the roles of the sea anchors are interchanged, whereby the pause between successive traction sessions can be limited to the time necessary for reversing the direction of operation of the winch means.

2. A method according to claim 1, wherein the cable means runs from one of the sea anchors to the other sea anchor via the winch means whereby the sum of the distances of the sea anchors ahead of the mass remains substantially constant.

3. A method according to claim 1 or 2, wherein the sea anchors are deployed one behind the other such that they tend to move towards each other during one alternation of the sequence and to move apart during the next alternation and so on.

4. A method according to claim 1, wherein the sea anchors are provided with spreader motors which serve to keep the sea anchor spread out during the traction sessions in which the sea anchor is being winched towards the large mass, and which serve to move the sea anchor forwards during the alternate traction sessions.

5. A method according to claim 1 wherein the traction winch means are provided on a winch vessel stationed ahead of the large mass and attached thereto by further cable means.

* * * * *